United States Patent [19]

Jones

[11] Patent Number: 4,857,682

[45] Date of Patent: Aug. 15, 1989

[54] PRECISELY ALIGNED SWITCH ACTUATOR ASSEMBLY FOR MULTIPLE SWITCHES

[75] Inventor: Theodore L. Jones, Lancaster, Pa.

[73] Assignee: Burle Technologies, Inc., Lancaster, Pa.

[21] Appl. No.: 257,764

[22] Filed: Oct. 14, 1988

[51] Int. Cl.[4] ..... H01H 3/20; H01H 15/00; H01H 21/24

[52] U.S. Cl. ..... 200/330; 200/547; 200/557

[58] Field of Search ..... 200/5 R, 6 R, 6 B, 6 BA, 200/1 A, 1 TK, 16 R, 17 R, 18, 302.2, 339, 341, 446, 449, 529, 533, 553, 551, 573, 330, 558

[56] References Cited

U.S. PATENT DOCUMENTS

| | | | |
|---|---|---|---|
| 2,824,197 | 2/1958 | Bolek | 200/330 |
| 2,870,299 | 1/1959 | Cox | 200/315 |
| 2,898,423 | 8/1959 | Collins | 200/330 |
| 2,909,624 | 10/1959 | Colautti | 200/6 R |
| 3,008,024 | 11/1961 | Roeser | 200/330 |
| 3,172,296 | 3/1965 | Tancred | 200/553 X |
| 4,324,956 | 4/1982 | Sakakino et al. | 200/6 R X |
| 4,352,964 | 10/1982 | English | 200/5 A |
| 4,358,646 | 11/1982 | Martinez | 200/5 R |
| 4,401,864 | 8/1983 | Ichikawa | 200/339 X |
| 4,425,487 | 1/1984 | Hsieh | 200/339 |
| 4,447,689 | 5/1984 | Schiller | 200/330 |
| 4,520,240 | 5/1985 | Swindler | 200/5 R |

*Primary Examiner*—J. R. Scott

*Attorney, Agent, or Firm*—Martin Fruitman

[57] ABSTRACT

An electrical switch actuator mechanism which has an accurately aligned position. The actuator operates printed circuit board pushbutton switches by depressing a spring finger to operate each pushbutton. Each of the fingers has a raised land with a precisely angled slope which a rub bar on the back of the actuator handle rides upon to depress the spring. However, the angled slope and the spring action of the leaf spring also act backward against the rub bar to precisely locate the position of the actuator handle so that a group of such switches are properly aligned when the switches are in the same position.

10 Claims, 3 Drawing Sheets

PRECISELY ALIGNED SWITCH ACTUATOR ASSEMBLY FOR MULTIPLE SWITCHES

SUMMARY OF THE INVENTION

This invention deals generally with electrical switch actuators and more specificaly with a switch actuator meant to be one of several side by side units which are precisely aligned when they are in one position.

An often neglected aspect of switch design is the precision of the location of the neutral position of the switch. This is not surprising since when a switch is mounted in an isolated location, small variations in the location of the one position, either after each operation of a switch or when one switch is replaced with another, have no effect on the operation of the switch and are likely not to be noticeable even if someone were looking for them.

However, if two or more switches are installed side by side, in a manner so that their actuators are to form a straight line, any variations in positions between switches are quite obvious. In such an arrangement, the play in the positions of the several switches detracts from the aesthetic appearance which led to the linear arrangement of the switches in the first place. In actual fact, a typical linear arrangement of multiple switches rarely looks like it is aligned since the play in the neutral position of each switch never allows all the switch actuators to be in line.

The present invention eliminates the above mentioned prior art problem. It offers an easily manufactured, economical switch with a precisely located neutral position and positive switch action in both directions from the neutral position. In the present invention the electrical contact function and detect function are separated, and the separation permits the detent function to be designed for precise location of the actuator.

The switch actuator of the present invention contains a keycap, the actuator part which is manually moved, with a rub bar on the backside of the keycap, inside the switch body. The rub bar is a narrow plastic part with rounded corners, with its backside approximately a half cylinder.

The rub bar acts on spring fingers each of which is anchored only at one end, has a spring action which pushes it toward the rub bar, and has a sloped bend in the direction of the rub bar near the end opposite its anchored end. Thus, as the rub bar is moved away from the anchored end of the leaf spring it rides up one slope of the bend and forces the leaf spring to deflect away from the rub bar. When the plateau of the bend in the leaf spring contacts the rub bar the maximum spring deflection is obtained. It is a leaf spring extension on the far side of the plateau which is used to accomplish the electrical action of the switch. The extension of the leaf spring is located above and aligned with the actuator of a conventional miniature push button switch. When the rub bar deflects the leaf spring as it moves up the slope of the bend, the leaf spring extension moves toward and activates the push button switch. Thus, the motion of the keycap is converted into an action that activates the push button switch.

In the preferred embodiment of the invention, a second leaf spring oriented in the opposite direction from the first operates in the same manner as the first lead spring, and keycap sliding motion in either direction therefore activates one or the other switch. The neutral position of the switch actuator is that position in which the rub bar has not moved in either direction suffciently to move up either leaf spring's slope sufficiently to deflect the spring significantly. It is the interaction of the two leaf springs and the rub bar which give the switch actuator mechanism its center-off detent and its highly accurate location.

The particular shape and angle of the slope of the bend in the leaf spring is what moves and holds the combined rub bar and keycap assembly at its precise neutral location. When the two oppositely oriented leaf springs are located so that they each just touch the rub bar with their sloped portion, the rub bar is held in a precisely repeatable neutral location with no play no permit variation. Moreover, in the preferred embodiment the angle of the sloped portion of each leaf spring is selected so that the spring will actually drive the rub bar back to the neutral position. It is therefore practical to install several such switches side by side with the assurance that all their keycaps will be in alignment when the switches are in the neutral position.

DETAILED DESCRIPTION OF THE INVENTION

Figure 1:
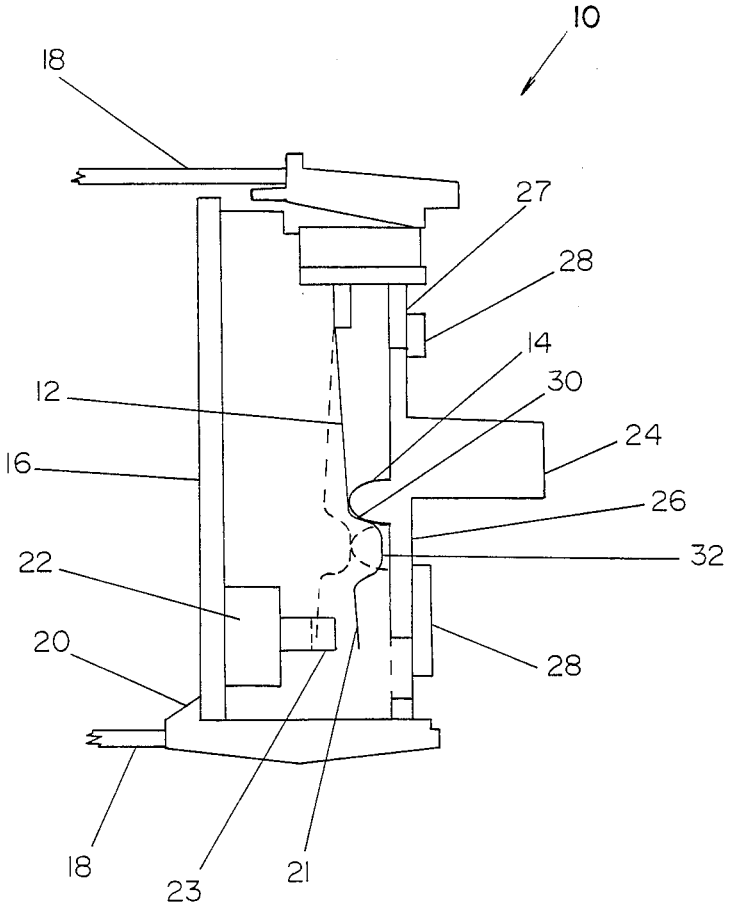
FIG. 1 is a simplified side view of the switch actuator internal mechanism of a preferred embodiment.

The preferred embodiment of the invention is shown in FIG. 1 which is a simplified internal view of switch actuator assembly 10. Only one of two spring fingers 12 is shown in the embodiment in FIG. 1 which depicts a two-position switch. The interaction of spring finger 12 and rub bar 14 can also be shown more clearly in a single spring finger embodiment.

Switch actuator assembly 10 is attached to circuit board 16 and switch body 18 by conventional attachment methods well known in the art, such as hook attachment 20. Similarly, circuit board pushbutton switch 22 is a conventional switch and its attachment to circuit board 16 is conventional. Switch 22 is aligned with extension 21 of spring finger 12.

The present invention departs from conventional design in the structure and function of keycap 24, rub bar 14 and spring finger 12. Spring finger 12 is part of a larger assembly, as shown in FIG. 3, and is used to accurately locate one position of keycap 24.

Keycap 24 and rub bar 14 are parts of a single handle assembly 26 which slides (vertically in FIG. 1) in track 28. As keycap 24 is moved within track 28 rub bar 14 acts upon spring finger 12 which, in turn, pushes down upon pushbutton switch 22.

Figure 2:
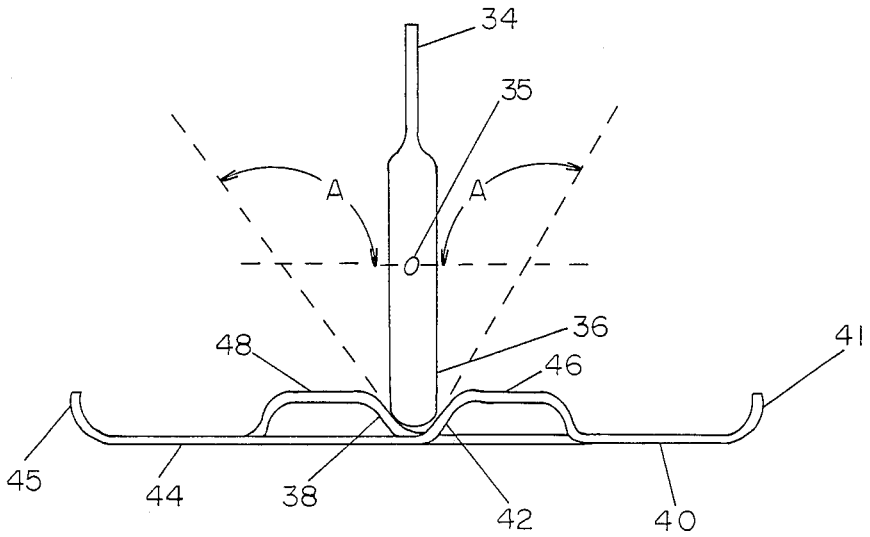
FIG. 2 is a simplified side view of the switch actuator assembly showing only the interaction between the rub bar and the spring fingers in an alternate embodiment.
Figure 3:
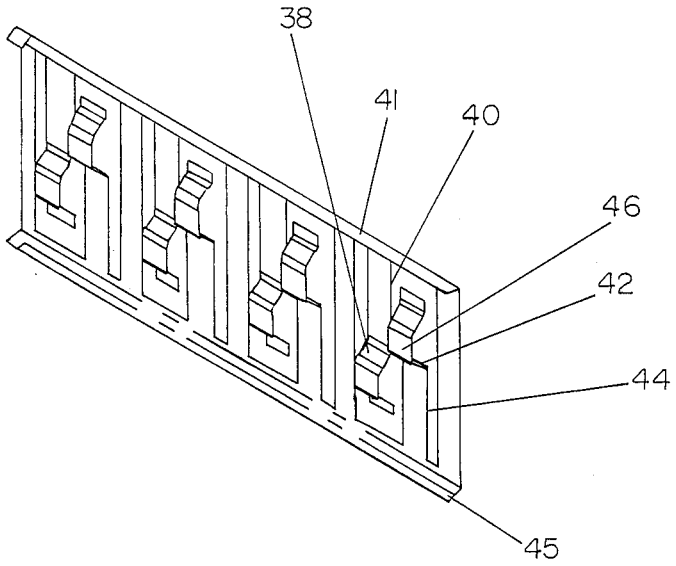
FIG. 3 is a perspective view of a spring finger assembly for a switch actuator with four switch assemblies.

This action occurs because spring finger 12, as shown in FIGS. 1, 2 and 3 has an angularly shaped bend 30 which protrudes in the direction of rub bar 14. Therefore, as rub bar 14 is pushed against the slope of bend 30, it forces spring finger 12 to deflect away from rub bar 14 and against switch 22 to activate switch 22 by pressing its pushbutton 23 with extension 21.

The position of spring finger 12, rub bar 14 and pushbutton 23 for actuation of switch 22 is shown in FIG. 1 by dashed lines. When rub bar 14 rides up on plateau 32 of spring finger 16, it comes to rest and thereby locks switch 22 into the depressed position.

The configuration of bend 30 also performs another vital function in the present invention. The slope of bend 30 creates a force which acts back against rub bar 14 to push handle assembly 26 and keycap 24 back into its neutral position. It is this reaction force from the spring finger acting in opposite directions which accurately positions keycap 24 in its neutral position.

As rub bar 14 is forced back to the position shown in FIG. 1 by the slope of bend 30, handle assembly 26 hits against stop 27 and accurately positions the off position of switch actuator assembly 10.

FIG. 2 shows only the rub bar and spring finger interaction for an alternate embodiment of the invention, a toggle switch which has three positions, with its neutral position between two switch activating positions. In FIG. 2, keycap 34 pivots on pivot point 35 causing rub bar 36 to move in an arc and ride up on either bend 38 of spring finger 40 which is attached to the switch body at end 41 or bend 42 of spring finger 44 which is attached to the switch body at end 45. The radius of movement of rub bar 36 is large enough so that rub bar 36 can also rest atop plateaus 46 and 48.

As shown in FIG. 2, rub bar 36, when in its neutral position, is actually trapped between bend 38 of spring finger 40 and oppositely acting bend 42 of spring finger 44. The reaction forces from both bend 38 and bend 42 push rub bar 36 into a highly accurate repeatable position so that even if the operator's actuating force on keycap 34 is removed when rub bar 36 is not in its neutral position, as long as rub bar 36 is on either bend 38 or 42, the rest position of rub bar 36 will be accurately repeatable.

Computations of these reaction forces, taking into account the spring force of spring fingers 40 and 44, the friction between rub bar 36 and bends 38 and 42, an the friction between keycap 34 and pivot point 35 indicate that the range of the angle A (FIG. 2) between the bend slope and the initial plane of movement of the rub bar must be between 100 and 150 degrees. Within the expected range of coefficients of friction, this range of angles will assure that the reaction force against rub bar 36 is sufficient to return it to its precise neutral position.

The precision of the neutral position for a group of adjacent switches will, of course, also be determined by the precision of the relationship between adjacent sets of spring fingers. This is accomplished, as shwon in FIG. 3, by constructing all the spring fingers of one group of switch actuator assemblies as a single spring finger assembly. When adjacent spring finger sets are formed as a single assembly, no inaccuracies can occur from assembly tolerances. Moreover, when the multiple spring finger assembly of FIG. 3 is formed by precisely machined dies, the accuracy of the parts is particularly high.

The present invention is therefore able to furnish a readily manufacured, economical, switch actuator assembly for multiple switch groups which not only operates well in its electrical function, but also furnishes precise alignment of the switch keycaps for a pleasing appearance.

It is to be understood that the form of this invention as shown is merely a preferred embodiment. Various changes may be made in function and arrangement of parts; equivalent means may be substituted for those illustrated and described; and certain features may be used independently from others without departing from the spirit and scope of the invention as defined in the following claims.

For instance, the far side of the bend in spring finger 12 need not complete a trapezoidal shape, or, indeed even exist. The interaction of spring finger 12 and rub bar 14 requires only a bend withone slope 30, the one which touches the rub bar, and plateau 32 to form a locked-in position if that is desired.

What is claimed as new and for which Letters Patent of the United States are desired to be secured is:

1. A switch comprising:

a switch body;

an actuator moveably attached to the switch body by a retaining means;

a rub bar with a rounded surface protruding from the rub bar, the rub bar being interconnected to and moving with the actuator;

at least one set of two spring fingers attached to the switch body and extending generally in the direction of the movement of the rub bar, each spring finger anchored to the switch body by an attachment means located at one end of the spring finger, beyond the movement of the rub bar, and each spring finger having an angular bend in the direction toward the rub bar, the angular bends being located so that when the actuator is in a prescribed position the rounded surface of the rub bar rests between the angular bends in the two spring fingers and is in contact with both angular bends and when the rub bar is in any position in contact with either angular bend other than in the prescribed position, the reaction force of the angular bend directs the rub bar toward the prescribed position; and at least two pushbutton switches, attached to the switch body, each with a pushbutton aligned with a movable operator section of one of the spring fingers, so that movement of the rub bar causes deflection of a a spring finger and the spring finger operator section moves a switch pushbutton.

2. The switch of claim 1 wherein the angle between the slope of each angular bend and the plane of movement of the rub bar as the rub bar just contacts the bend defines an angle in the range between 100 and 150 degrees.

3. The switch of claim 1 further including a plateau atatched to and approximately parallel to the body of a spring finger at one end of a spring finger angular bend so that the rub bar will ride over the angular portion of the bend and rest on the plateau with no force being applied to the rub bar to cause movement.

4. The switch of claim 1 wherein the actuator is slideably attached to the switch body by means of a retaining means which is a track.

5. The switch of claim 1 wherein the actuator is pivotably attached to the switch body by means of a retaining means which is a pivot point.

6. A switch comprising:

a switch body;

an actuator moveably attached to the switch body by a retaining means;

a rub with a rounded surface protruding from the rub bar, the rub bar being interconnected to and moving with the actuator;

at least one spring finger attached to the switch body and extending generally in the direction of the movement of the rub bar, the spring finger anchored to the switch body by an attachment means located at one end of the spring finger beyond the movement of the rub bar, and the spring finger having an angular bend in the direction toward the rub bar, the angular bend being located so that when the actuator is in a prescribed position against a stop, the rounded surface of the rub bar rests in contact with the angular bend and when the rub bar is in any position in contact with the angular bend other than in the prescribed position, the reaction force of the angular bend directs the rub bar tc vard the prescribed position; and at least one pushbutton switch, attached to the switch body, with a pushbutton aligned with a movable operator section of at least one spring finger, so that movement of the rub bar causes deflection of the spring finger and the spring finger operator section moves a switch pushbutton.

7. The switch of claim 6 wherein the angle between the slope of the angular bend and the initial plane of movement of the rub bar as the rub bar just contacts the bend defines an angle in the range between 100 and 150 degrees.

8. The switch of claim 6 further including a plateau attached to and approximately parallel to the body of a spring finger at one end of a spring finger angular bend so that the rub bar will ride over the angular portion of the bend and rest on the plateau with no force being applied to the rub bar to cause movement.

9. The switch of claim 6 wherein the actuator is slideably attached to the switch body by means of a retaining means which is a track.

10. The switch of claim 6 wherein the actuator is pivotably attached to the switch body by means of a retaining means which is a pivot point.

* * * * *